US006968865B2

(12) United States Patent
Yamamoto

(10) Patent No.: US 6,968,865 B2
(45) Date of Patent: Nov. 29, 2005

(54) REED FOR WEAVING

(75) Inventor: Akihiko Yamamoto, Ishikawa-ken (JP)

(73) Assignee: Tsudakoma Kogyo Kabushiki Kaisha, (JP)

( * ) Notice: Subject to any disclaimer, the term of this patent is extended or adjusted under 35 U.S.C. 154(b) by 208 days.

(21) Appl. No.: 10/601,414

(22) Filed: Jun. 23, 2003

(65) Prior Publication Data

US 2004/0020548 A1 Feb. 5, 2004

(30) Foreign Application Priority Data

Aug. 1, 2002 (JP) ..... 2002-224387

(51) Int. Cl.[7] ..... D03D 49/62
(52) U.S. Cl. ..... 139/192; 139/435.6
(58) Field of Search ..... 139/192, 435.6

(56) References Cited

U.S. PATENT DOCUMENTS 3,847,187 A * 11/1974 Buran et al. ..... 139/435.5
4,125,133 A * 11/1978 Kobayashi et al. ..... 139/435.6
5,323,814 A * 6/1994 Shiraki et al. ..... 139/192
5,518,041 A * 5/1996 Sora et al. ..... 139/192
5,570,726 A * 11/1996 Wahhoud et al. ..... 139/434
5,782,271 A 7/1998 Czura et al.
6,019,139 A * 2/2000 Thompson, III ..... 139/192
6,079,453 A * 6/2000 Richardson, III ..... 139/192
6,394,146 B2 * 5/2002 Satou et al. ..... 139/192
6,401,762 B1 * 6/2002 Peeters ..... 139/192

FOREIGN PATENT DOCUMENTS

JP 02-269833 11/1990
JP 09-268454 10/1997
JP 10 204753 A 9/1998

* cited by examiner

*Primary Examiner*—John J. Calvert
*Assistant Examiner*—Robert H Muromoto
(74) *Attorney, Agent, or Firm*—The Webb Law Firm

(57) ABSTRACT

This reed for weaving is characterized in that a plurality of reed dents each having a hollow portion in a front edge section are arranged such that the hollow portions are communicated with each other so as to form guide grooves for the weft, the depths of the hollow portions of the reed dents located at least at one end portion are made larger than the depths of the hollow portions of the other reed dents, and that the nearer the central side in the weft insert direction, the smaller the depths of the hollow portions of the reed dents are made so as to become approximate to the depths of said hollow portions of the other reed dents, and further, areas including portions corresponding to the hollow portions in the rear edge section of the reed dents are projected backward.

4 Claims, 6 Drawing Sheets

28
34
34a
42
24a
48
22a
32
30
46
26
(24)
44
38
22
22b
36
36a
24b
40

50
52
24b
42
26
42
36

42
46
26
(24)
30
42
36a
36
22b
32

34
42
26
42
36
22b
22
22a
38
44

42
46
26
(24)
30
42
34
34a
48
22a
32
36
36a 34
34a
42
24a
48
46
26
(24)
38
44
22a
22
22b
30
32
36
36a
28
40
24b

REED FOR WEAVING

BACKGROUND OF THE INVENTION

1. Field of the Invention

This invention relates to a reed for weaving such as a divided reed or a single reed used for a loom.

2. Description of Related Art

A loom produces a cloth, repeating such steps as: dividing a plurality of warps into a plurality of groups of the warps; forming a warp shedding by vertically moving in every group those warp groups with a shedding device; making the weft run into the shedding; and thereafter, beating the weft with a reed for weaving including a plurality of reed dents.

Each reed dent has a projected portion in a front edge section located at one side. In the projected portion, a hollow portion is formed, and a rear edge section located at the other side is made flat. The reed is formed by combining the plurality of the reed dents with the hollow portions communicated with each other so as to form guide groove for the weft.

As one of factors of the performance of a loom, smoothness in weft running is given. Techniques to facilitate the weft running from the weft insert side are described in the Official Gazettes of Japanese Patent Appln. Public Disclosures No. 2-269833 and No. 9-268454, in which the dimension between the upper end and lower end of a weft guide groove is made larger and larger toward the weft insert side.

The guide grooves in both prior techniques have a so-called tapered shape such that the depth of the hollow portions of the reed dents located at the weft insert side are larger than that of the hollow portions of the other reed dents, and the nearer the central side in the insert direction they are located, the smaller (shallower) the depth becomes so as to become approximate to the depth of the hollow portions of the other reed dents. Here, by the other reed dents is meant, more specifically, the remaining reed dents between which the warps are to be passed.

In both above-mentioned techniques, however, the shape of the rear edge section of each reed dent located at the weft insert side is made substantially flat just like the shape of the rear edge section of another reed dent; therefore, if the depth of the hollow portion is enlarged so as to enlarge the tapered shape of the guide groove, the distance between the hollow portion and the rear edge section is remarkably shortened, thereby lowering the strength of the reed dent itself.

SUMMARY OF THE INVENTION

An object of the present invention is to provide a guide groove to facilitate weft insertion without lowering the strength of the reed dent.

The reed according to the present invention has a plurality of reed dents each of which includes a front edge section and a rear edge section, and the reed dents each of which has a hollow portion for guiding the weft in the front edge section are arranged such that the hollow portions are communicated with each other so as to form a guide groove. The depth of the hollow portions of the reed dents located at least at one end portion in the weft insert direction are larger than that of the hollow portions of the other reed dents, and the nearer the central side in the weft insert direction, the smaller the depth of the hollow portions of the reed dents are made so as to become approximate to the depth of the hollow portions of the other reed dents, and areas including positions corresponding to the hollow portions in the rear edge sections of the reed dents the one end portion are projected backward.

The above-mentioned reed is assembled into the loom, making larger the depth of the hollow portions of the reed dents at the weft insert side. In case the area including the portion corresponding to the hollow portion in the rear edge section of each reed dent located at the weft insert side is projected backward, the strength of the reed dents is not lowered even if the depth of the hollow portions of the reed dents is enlarged and the facility and smoothness in the weft insertion are raised.

It is preferable to flatten the rear edge sections of the other reed dents. Thus, since the dimension of the other reed dents in the forward and backward direction becomes smaller, the reed can become light as a whole, and the inertial force of the reed accompanying the beating motion can be made small. This makes the motion of the reed faster, thereby shortening the beating time and operating the loom at a high speed.

It is possible to make the vertical dimension between the upper and lower parts of the hollow portions of the reed dents larger than that of the other reed dents, while that of the hollow portions of the reed dents located nearer the central side in the weft insert direction are made smaller, thus enabling more stable weft insertion.

The reed according to the present invention may be applied to a so-called single reed whose plurality of reed dents are assembled into common upper and lower caps (fixing members), or may be applied to a so-called divided reed whose plurality of reed dents are assembled into upper and lower caps.

PREFERRED EMBODIMENTS OF THE INVENTION

Figure 1:
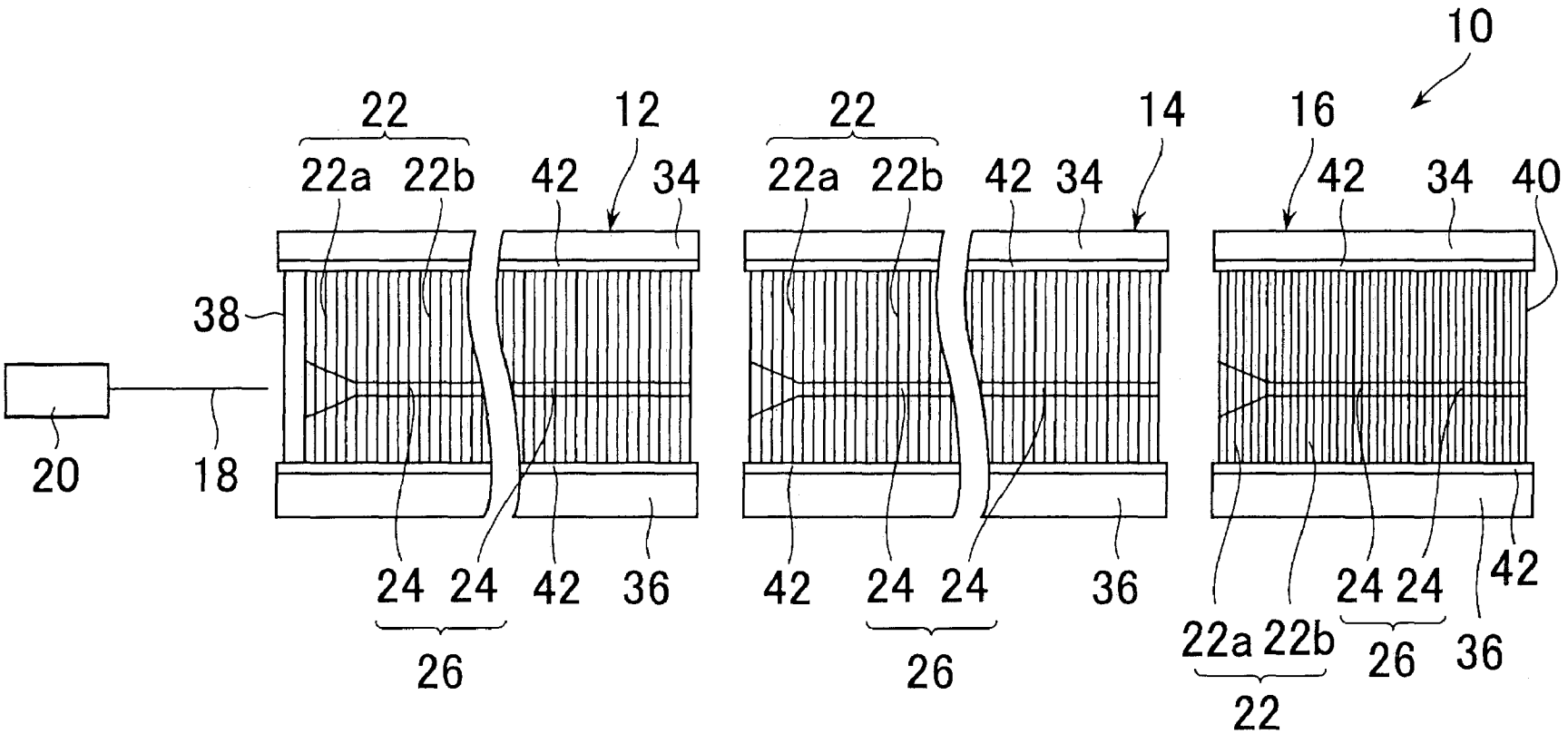
FIG. 1 is a schematic drawing showing an embodiment of the reed for weaving according to the present invention.

Referring to FIG. 1, the reed 10 for weaving has a divided reed 12 of the first width, a divided reed 14 of the second width and a divided reed 16 of the third width (the last width) arranged in series at intervals in the weft insert direction (rightward and leftward direction). The weft 18 is jetted from a weft insert nozzle 20 together with the compressed air and inserted into a warp shedding.

Each of the divided reeds 12, 14, 16 has a plurality of reed dents (i.e. reed blade) 22 arranged in parallel to each other at intervals in the weft insert direction, and forms a guide groove 26 for the weft 18 by the hollow portion 24 formed in the reed dents 22. Each hollow portion 24 has a one-side open rectangular shape with the corners rounded by the upper and lower faces 24*a*, 24*a* and the depth bottom portion (depth bottom face) 24*b*.

Figure 2:
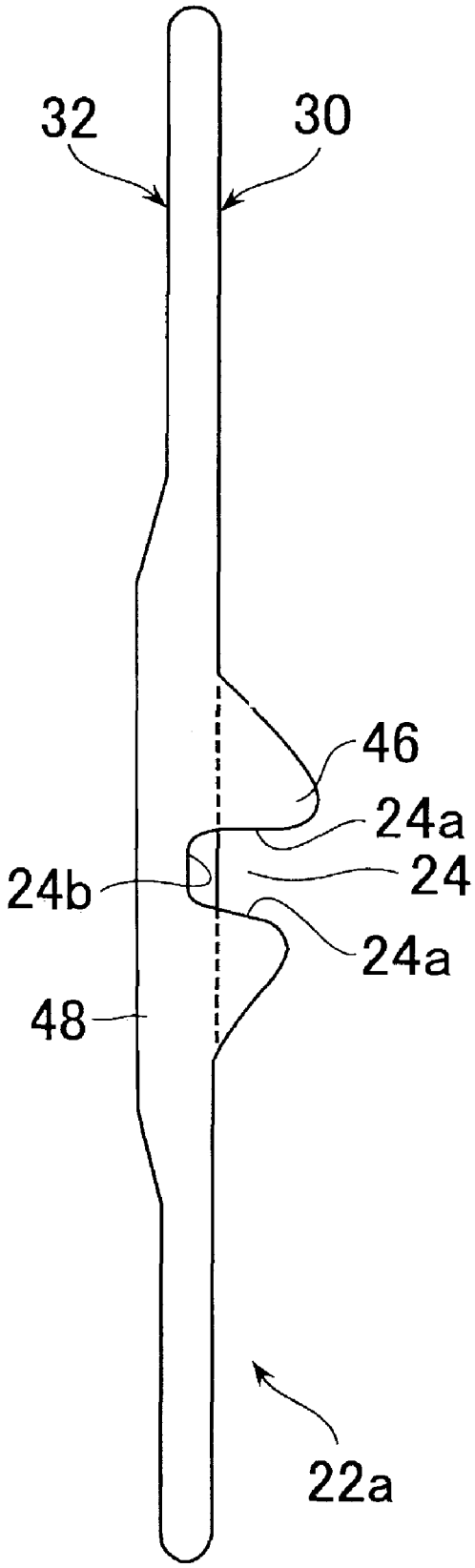
FIGS. 2(A) and (B) are views showing one embodiment of the reed dent used in the reed for weaving shown in FIG. 1, in which (A) is a schematic side view of the reed dent located at the weft insertion side, and (B) a schematic side view of the reed dent.
Figure 2:
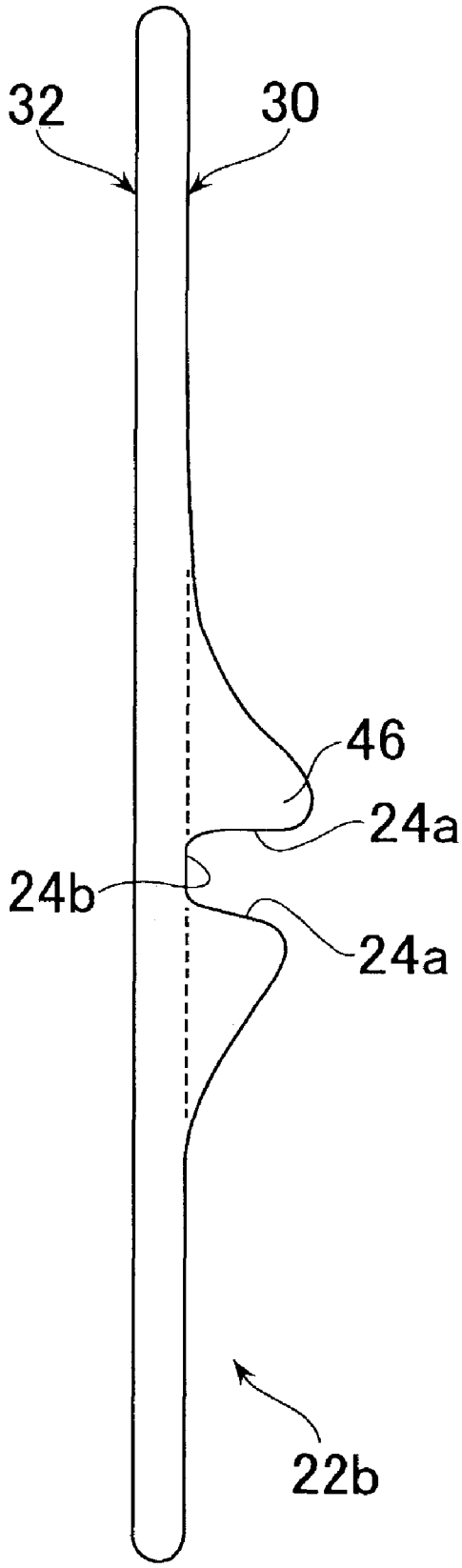

As shown in FIG. 2, each reed dent 22 is shaped like a band elongated in the vertical direction and having a substantially constant thickness with both front end portions rounded. Each reed dent 22 has a front edge section 30 which is to be a cloth fell side, and a rear edge section which is to be a non-cloth fell side, as explained later.

Figures 3A, 3B, 3C, 3D:
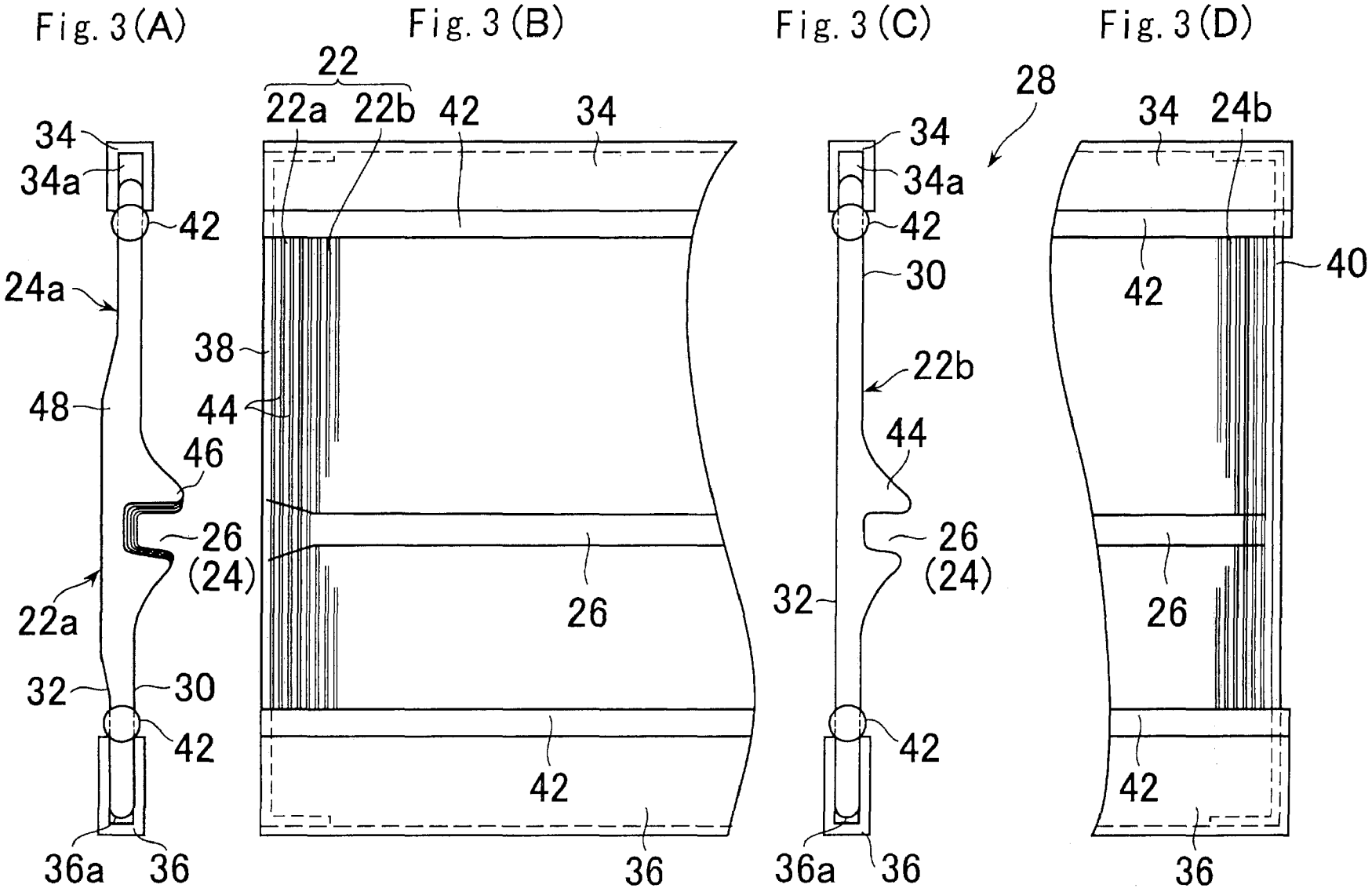
FIGS. 3 (A), (B), (C) and (D) are views showing details of the reed for weaving (divided reed or single reed), in which (A) is a side view of the weft insert side, (B) a front elevation of the weft insert side, (C) a side view of the central part, and (D) a front elevation of the non-insert side.
Figure 4:
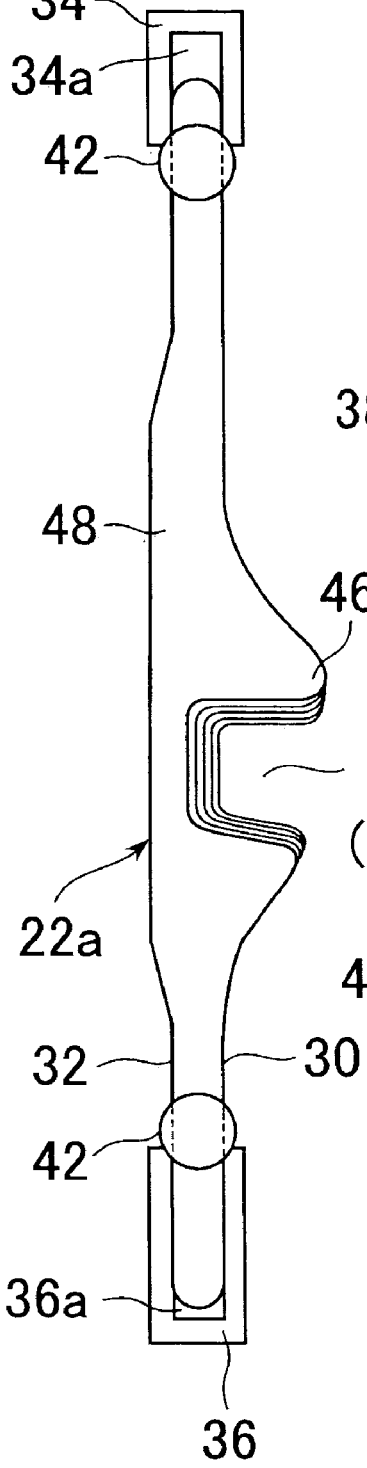
FIGS. 4(A) and (B) are partially enlarged views of the reed for weaving shown in FIG. 3, in which (A) is a side view, and (B) a front elevation of the weft insert side.
Figure 4:
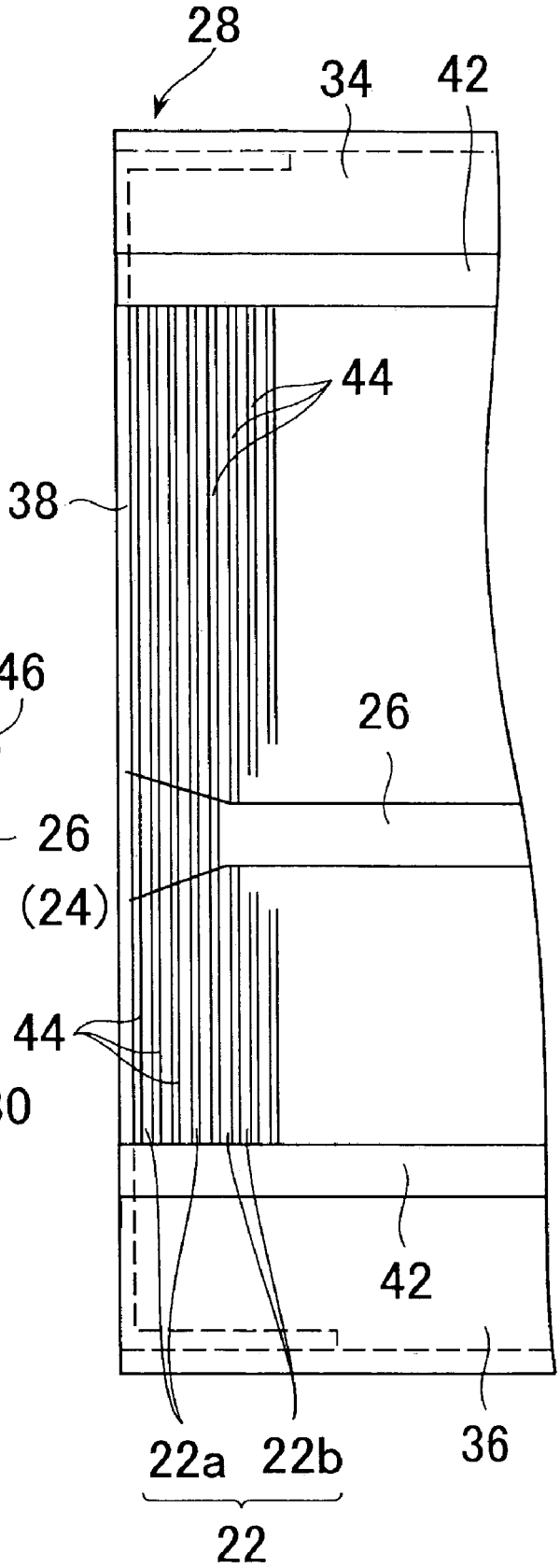

Each of the divided reeds 12, 14, 16 is formed, like the reed 28 for weaving shown in FIGS. 3 and 4, by a plurality of reed dents 22, upper and lower caps (attaching members) 34, 36, and right and left side caps (connecting members) 38, 40. Each guide groove 26 is formed by making the hollow portion 24 in each reed dent 22 communicated with each of the divided reeds 12, 14, 16.

The upper and lower parts of the reed dents 22 are inserted into a groove 34*a* of the upper cap 34 and a groove 36*a* of the lower cap 36, respectively, having a one-side open rectangular sectional shape, such that the reed dents 22 are juxtaposed in the weft insert direction and that their thickness direction is made to be the weft insert direction and so that the hollow portions of every divided reed can be aligned to form a guide groove 26.

A space between adjacent reed dents 22 is made to be a space 44 for passing the warp by a pair of spacers 42 disposed at an interval in the vertical direction (See FIG. 4). In the illustration, the spacer 42 is a compressive or tensile type coil spring, and each ring-shaped part of the coil spring 42 is located between the adjacent reed dents 22 to maintain the space.

The reed 28 for weaving can be assembled, with a plurality of reed dents 22 arranged as mentioned above, by inserting side caps 38 and 40 acting as master blades into the weft insert side and the non-insert side and attaching the side caps 38 and 40 respectively to the upper and lower caps 34 and 36 with rivets, stopping screws, or the like.

Each of the side caps 38, 40 is formed in a one-side open rectangular shape with both end portions of a band-like plate slightly thicker than the reed dent 22 bent in the thickness direction, and attached to the upper and lower caps 34, 36 so as not to block the hollow portion 24 of the reed dent 22 positioned at the end portion. For example, the side caps 38 and 40 can have substantially the same vertical dimension as the dimension from the rear edge section 32 to the hollow portion 24 of the reed dent 22 at the weft insert side end and the non-insert side end.

The divided reeds 12, 14, 16 using the reed 28 for weaving assembled as mentioned above are incorporated in series into a reed sleigh (not shown) attached to an arm (not shown) in the lower cap 36 such that the guide grooves 26 are located in the area where there is the warp and are communicated with each other and so as to oppose the cloth fell of the cloth.

As shown in FIGS. 2(A) and (B), each reed dent 22 has a projected portion 46 near the center of the front edge section 30 which is the cloth fell side of the cloth, and has the hollow portion 24 in the projected portion 46.

As shown in FIG. 2(A), the position of the depth bottom part 24*b* of the hollow portion 24 of the reed dent 22*a* located at the weft insert side end portion is a position toward the side of the rear edge section 32 from the extended line of the front edge section 30 in the forward and backward direction. Therefore, the depth of the hollow portion of each reed dent 22*a* can be enlarged.

Of the rear edge section 32 of the reed dent 22*a*, the central area in the vertical direction including the portion corresponding to the hollow portion 24 is projected as a projected area 48, which is more outward than both end portions of the rear edge section 32 of the reed dent to be inserted into the upper and lower caps 34, 36 in the forward and backward direction. By this, since the projected area 48 can be secured even if the depth of the hollow portion of each reed dent 22*a* is made large enough to raise facility and smoothness in weft insertion, the strength of the reed dent 22*a* is not lowered.

In the illustration, the range of the projected area 48 of the reed dent 22*a* is substantially the same as the range of the projected portion 46. The shape of the projected area 48 is substantially trapezoidal in this figure but is not limited to it. It suffices for the projected area 48 to have a range and a shape by which the strength of the reed dent 22*a* can be maintained. For example, in the area including the portion corresponding to the hollow portion 24, the projected area 48 may be shaped like a circular arc so that the vertical dimension from the rear edge section of the projected area 48 to the depth bottom part 24*b* may be constant.

On the other hand, the depth bottom part 24*b* of each of the other reed dents 22*b* is, as shown in FIG. 2(B), substantially in the same position as the extended line of the front edge section 30 in the forward and backward direction. Also, the other rear edge section 32 of each of the other reed dents 22*b* is linear (i.e., flat) over the entire length in the vertical direction of the reed dent 22*b*.

The depths of the hollow portions 24 of the other reed dents 22*b* are the same. However, the vertical dimension from the depth bottom part 24*b* to the rear edge section 32 of each reed dent 22*b* is made substantially the same as the vertical dimension of the lower end portion area of the reed dent 22*b*. It is intended thereby to keep the mechanical strength uniform in the entire reed dent 22*b* and to lighten each divided reed.

The depths of the hollow portions 24 of the reed dents 22*a* located at the end portion on the weft insert side are made larger than the depths of the hollow portions 24 of the other reed dents 22*b* shown in FIG. 2(B), and the nearer the central side in the weft insert direction, the smaller the depths the hollow portions 24 of the reed dents 22*a* are made so as to become approximate to the depths of the hollow portions 24 of the other reed dents 22*b*. Therefore, the depth of the guide groove 26 of each divided reed is gradually shallowed from the weft insert side toward the non-insert side and is made constant from halfway in the weft insert direction.

In the plurality of reed dents 22*a* located at the end portion on the weft insert side, however, the projected areas 48 are provided at the rear edge sections 32, so that the vertical dimension from the rear edge section of the projected area 48 to the depth bottom part 24*b* of the hollow portion 24 can be made substantially the same as the dimension between the upper and lower end areas of the reed dent 22*a*, or the dimension from the depth bottom part 24*b* to the rear edge section 32 of the reed dent 22*b*. Therefore, also in the reed dent 22*a*, the mechanical strength around the hollow portion 24 does not become lower than the strength of the other portion.

It is preferable that the vertical dimensions of the hollow portions 24 of the reed dents 22*a* located at the weft insert side be gradually made narrower toward the central side in the weft insert direction, and that the vertical dimension of the hollow portion 24 of the reed dent 22*a* nearest to the other reed dent 22*b* be made larger than the vertical dimension of the hollow portion 24 of the other reed dent 22*b* so as to become the most approximate to the vertical dimension of the hollow portion 24 of the other reed dent 22*b*. By this, the vertical dimension of the guide groove 26 of each divided reed is gradually narrowed from the weft insert side toward the non-insert side and made constant from halfway in the weft insert direction. Thus, the guide groove 26 may be tapered not only in the depth direction but also in the cross direction.

In the illustration, there are five reed dents 22*a* which shaped as mentioned above but the number of such reed dents 22*a* is not restricted to five.

Also, in place of making all the reed dents 22*a* whose depths are larger than the depth of the hollow portion 24 of the other reed dent 22*b* have the projected areas 48 at the side of the rear edge sections 32, it is possible to constitute, for example, such that, the rear edge section 32 of those reed dents 22*a*, only four or less of the reed dents 22*a* at the weft insert side have the projected areas 48, and that the rear edge section 32 of one or more of the remaining reed dents 22*a* has a flat shape similar to that of the reed dent 22*b*.

Further, it is not necessary that all the projected area 48 has the same size but, so long as the strength of the reed dent 22*a* can be maintained, every reed dent 22*a* may have the projected area 48 of a size different from others. For example, the sizes of the projected areas 48 may be gradually made smaller toward the non-insert side.

As mentioned above, if the depth and the vertical dimension of the guide groove 26 of each divided reed are gradually made smaller and smaller from the weft insert side toward the non-insert side, the facility and smoothness in weft insertion is improved.

Also, by forming the projected area 48 projecting backward in the central area of the rear edge section 32 of the reed dent 22*a*, the depth of the hollow portion 24 of the reed dent 22*a* can be enlarged, while if such a projected area is not formed in the other reed dent 22*b*, the strength of the reed dent 22*a* is not lowered, so that, though the entire divided reed is light, the mechanical strength thereof is not lowered.

Further, by forming the projected area 48 in the rear edge section 32 of the reed dent 22*a* and making the rear edge section 32 of the reed dent 22*b* flat, the dimension in the forward and backward direction of the reed dent 22*b* becomes small, so that the divided reed becomes light as a whole, and the inertial force of the divided reed accompanying the beating motion becomes small. As a result, since the movement of the reed becomes faster, the beating time can be shortened and the loom can be operated at a high speed.

Figure 5:
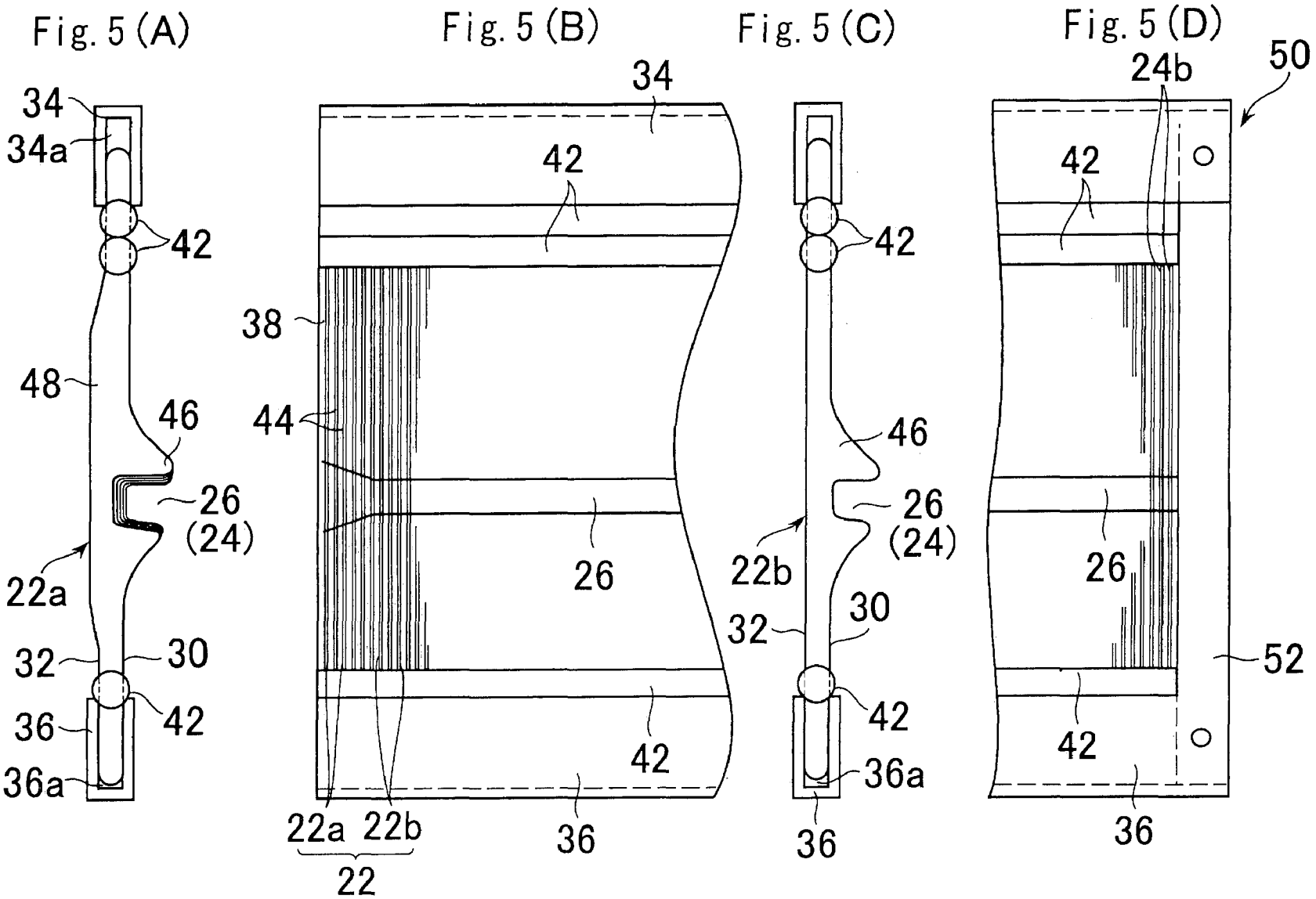
FIGS. 5(A), (B), (C) and (D) are views showing another embodiment of the reed for weaving (divided reed or single reed), in which (A) is a side view of the weft insert side, (B) a front elevation of the weft insert side, (C) a side view of the central part, and (D) a front elevation of the non-insert side.

All of the divided reeds 12, 14, 16 can have the shape as mentioned above, but they may have other shapes, for example, the shape shown in FIG. 5. In particular, the divided reed 16 in the last width (the non-insert side) preferably has the shape shown in FIG. 5.

Referring to FIG. 5, the reed 50 for weaving is formed to be the same as the reed 28 for weaving as shown in FIGS. 3 and 4, except that it has two spacers 42 at the upper side and that the side master blade 52 located at the end portion on the weft non-insert side is formed with a band-like plate member having substantially the same thickness as the vertical dimension from the rear edge section 32 to the depth bottom portion 24*b* of the hollow portion 24 of the reed dent 22*b*.

Figures 6A, 6B, 6C, 6D:
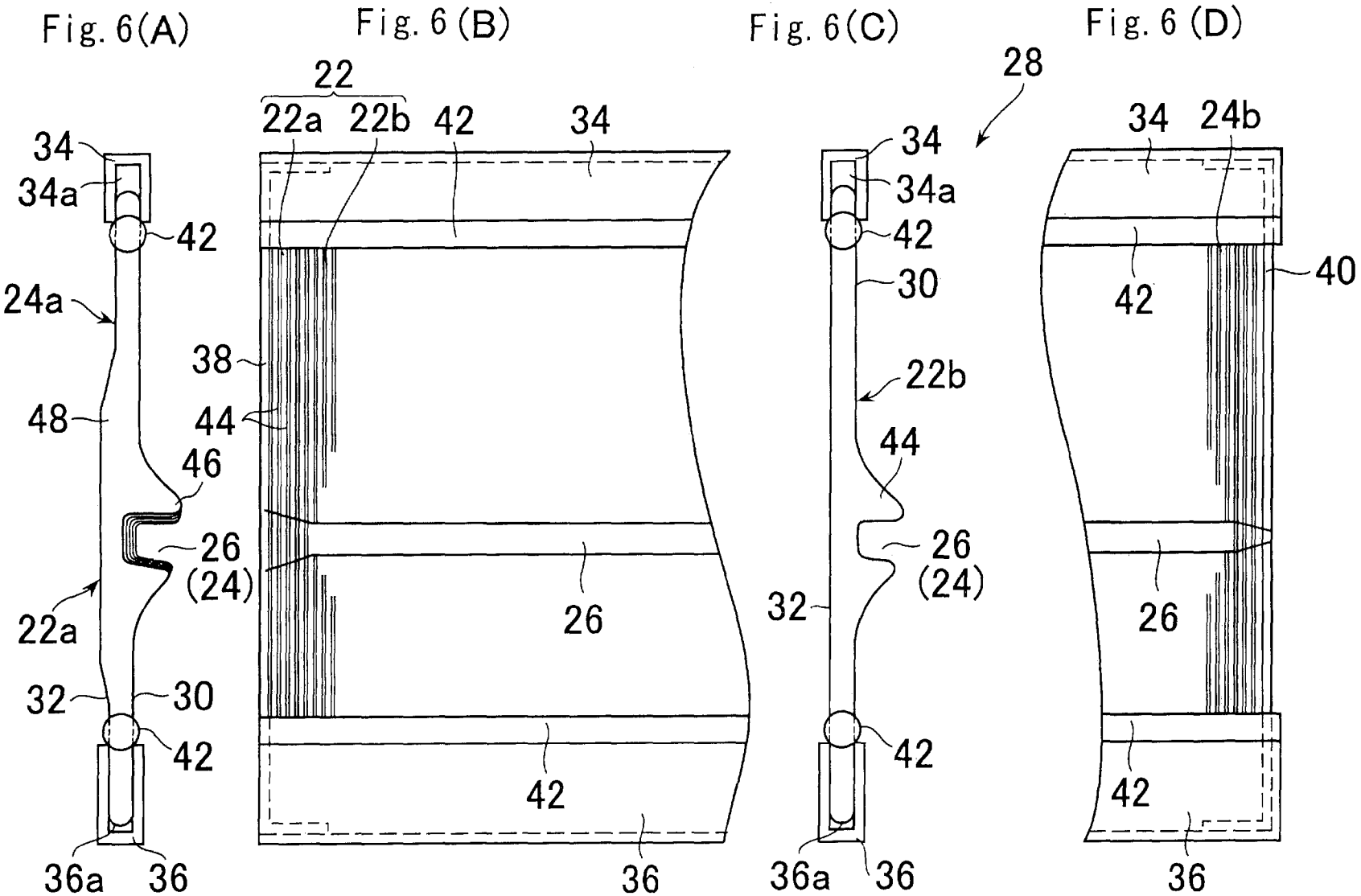
FIGS. 6(A), (B), (C) and (D) are views showing another embodiment of the reed for weaving (divided reed or single reed), in which (A) is a side view of the weft insert side, (B) a front elevation of the weft insert side, (C) a side view of the central part, and (D) a front elevation of the non-insert side.

Consequently, the reed 50 for weaving shown in FIG. 5 can be used like the reed 28 for weaving shown in FIGS. 3 and 4, thereby bringing about substantially the same action and effect as when the reeds 28 for weaving as shown in FIGS. 3 and 4 are used. FIG. 6 shows, in contrast to the embodiment in FIG. 3, the reed in which the vertical dimension of the hollow portions of the reed dents located at the end portion on the non-insert side is made smaller toward the non-insert side. If this reed 28 for weaving is used, the facility and smoothness in weft insertion of the reed dents at the non-insert side are improved.

The structures of the reeds 28 for weaving shown in FIGS. 3, 4 and 6 and that of the reed 50 for weaving shown in FIG. 5 can be applied to a single reed formed integrally with a plurality of reed dents arranged at intervals in the weft insert direction.

In both divided reed and single blade, it is possible to form the projected areas 48 at the rear edge sections 32 of all the reed dents 22, to enlarge the depth of each hollow portion 24, and to enlarge the depth of each guide groove 26. In this case also, the hollow portions 24 of the reed dents 22*a* located at the weft insert side are formed like the reed dent 22*a* in the above embodiment.

Instead of forming the guide grooves 26 of all the divided reeds to have such a tapered shape as mentioned above, it is possible to shape the guide groove of one or more divided reeds located at the weft insert side, for example, the guide grooves 26 of the divided reeds 12, 14 may be tapered.

There are looms in which the weft insert side comes to the left, right, or both right and left sides. All the above-mentioned embodiments are applied to looms that insert the weft from the left side.

However, the reed used for the loom to insert the weft from the right side is formed such that the hollow portions 24 of the reed dents located at the right end portion are shaped like the foregoing reed dents 22*a*. Also, the reed to be used for the loom which inserts the weft from both right and left sides are formed such that the hollow portions 24 of the reed dents located at each of the right and left end portions have such a shape as the foregoing reed dents 22*a*.

Therefore, in the reed for weaving according to the present invention, it suffices that a plurality of reed dents located at least at one end portion in the rightward and leftward direction have the hollow portions 24 like the forgoing reed dent 22*a*.

The present invention is not limited to the above embodiments but can be variously modified without departing from its purport.

What is claimed is:

1. A reed for weaving, wherein a plurality of reed dents, each including a front edge section and a rear edge section, the reed dents having hollow portions for guiding the weft, are arranged such that said hollow portions are communicated with each other so as to form guide grooves for the weft, wherein the depths of said hollow portions of the reed dents located at least at one end portion in the weft insert direction are made larger than the depths of the hollow portions of other reed dents and, the nearer the central side in the weft insert direction the reed dents are located, the smaller the depths of the hollow portions are made so as to become approximate to the depths of said hollow portions of said other reed dents, and wherein, in said reed dents at the one end portion, areas including portions corresponding to said hollow portions in said rear edge sections are projected backward, and wherein said rear edge section of said other reed dents are flat such that the dimension of said other reed dents in the forward and backward direction becomes smaller than that of said reed dents having said portion projected backwards.

2. A reed described in claim 1, wherein the vertical dimension between the upper and lower parts of the hollow portions of said reed dents at the one end portion are made larger than the dimension between the upper and lower parts of said hollow portions of said other reed dents and the nearer the central side in the weft insert direction the reed dents are located, the smaller the hollow portions of the reed dents are made.

3. A reed described in claim 1, wherein said reed is a single reed.

4. A reed described in claim 1, wherein said reed is a divided reed.

* * * * *